United States Patent [19]

Shmelkin

[11] 4,365,727

[45] Dec. 28, 1982

[54] DEVICE FOR SQUEEZING-OUT VISCOUS MATERIALS FROM TUBES MADE OF PLASTICS

[76] Inventor: Mark Shmelkin, Haemek st. I/4, Nesher, Israel

[21] Appl. No.: 177,636

[22] Filed: Aug. 13, 1980

[51] Int. Cl.[3] ..... B65D 35/28

[52] U.S. Cl. ..... 222/97; 222/101; 222/103

[58] Field of Search ..... 222/97, 101, 102, 103; 251/6, 9

[56] References Cited

U.S. PATENT DOCUMENTS

| | | | |
|---|---|---|---|
| 1,032,664 | 7/1912 | France | 251/9 |
| 2,197,310 | 4/1940 | Lincoln | 251/9 X |
| 2,358,989 | 9/1944 | Marcy | 222/102 |
| 3,648,701 | 3/1972 | Botts | 251/6 X |

FOREIGN PATENT DOCUMENTS

| | | | |
|---|---|---|---|
| 525575 | 5/1955 | Italy | 222/103 |

*Primary Examiner*—Joseph J. Rolla
*Assistant Examiner*—Frederick R. Handren

[57] ABSTRACT

A device executed in the form of two hinged frames secured together with a hinge axle and fitted with a spring and a squeezing roll, provided with a sleeve. The bottom part of the tube is to be inserted under the squeezing roll; both frames being pressed by fingers are drawn along the length of the tube. The present invention makes it possible to squeeze out practically all the contents of a tube.

3 Claims, 11 Drawing Figures

DEVICE FOR SQUEEZING-OUT VISCOUS MATERIALS FROM TUBES MADE OF PLASTICS

BACKGROUND OF THE INVENTION

The present invention relates to the field of application of tubes made of plastics containing viscous materials such as, for example, various pastes and creams (cosmetic and medical), different lubricants for technical use, and others as well, and more particular, to the field of squeezing viscous materials out of tubes made of plastics.

As it is well known tubes made of plastics, unlike metal tubes, assume their original form immediately after the compression pressure exerted on said tubes is released. This feature of tubes made of plastics prevents the tube contents from being completely taken out from said tubes. As a result up to 10% of valuable materials are thrown out together with an used tube.

Devices designed for squeezing viscous materials out of tubes made of plastics are known, for example, "Tube Squeezing Device" (see U.S. Pat. No. 4,030,636, cl 222-102). But all the existing devices, designed for this purpose, are expensive, present difficulties in fabrication and are not convenient in use. For said reasons such devices are not attractive to customers buying various viscous materials in tubes made of plastics.

By the present invention a device comprising two frames, secured together with a hinge axle, a squeezing roll, a sleeve and a spring is proposed.

The proposed device features the following advantages:

low cost of production;

simplicity of design and ease of fabrication (see FIG. 2-FIG. 8);

convenience in use;

complete squeezing-out of viscous materials contained in a tube made of plastics (see FIG. 10, FIG. 11).

SUMMARY OF THE INVENTION

The essence of the invention is as follows.

The proposed device is executed in the form of two frames, one of which being wider than the other one, with side flanges and end flanges provided around their perimeter. Both frames are secured along one of their ends with a hinge axle. The proposed device is provided with a squeezing roll. A freely rotating sleeve can be fitted on said roll, said sleeve being made, for example, of plastics. The ends of said squeezing roll are inserted in the slots made in the flange of one of the frames. At both ends of said squeezing roll holes are provided and the spring arms are secured therein. The transverse part of said spring is positioned along an end flange of one of the frames and its arms—along the flange of the second frame.

Said spring, acting on both frames and on the squeezing roll, builds up a sufficient constant pressure ensuring the required tube compression and firm fixation of the proposed device on said tube. In this manner the device squeezes the tube contents towards the tube outlet, and as this takes place the rear part of the tube remains practically completely empty.

DESCRIPTION OF THE PREFERRED EMBODIMENT

Figure 1:
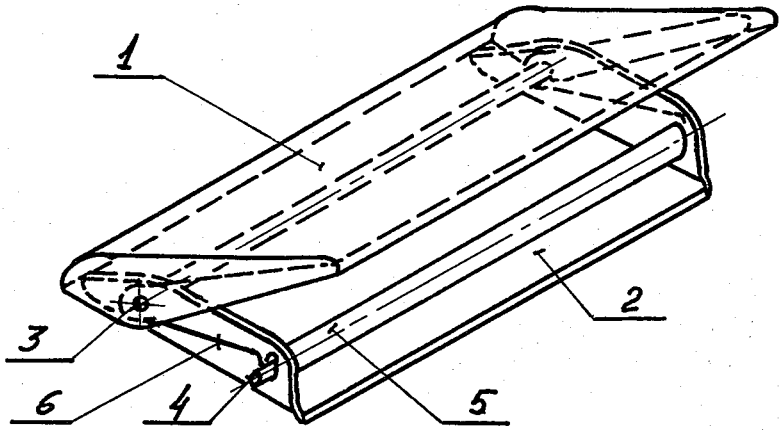
FIG. 1 is a general view of the proposed device in axonometric projection.
Figure 3:
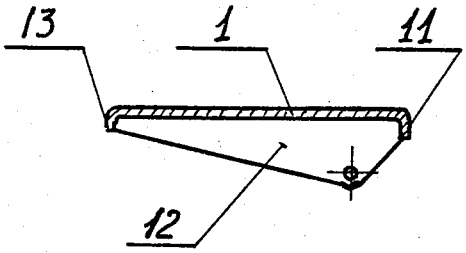
FIG. 3 is a section along 3—3 of the frame of greater width.
Figure 2:
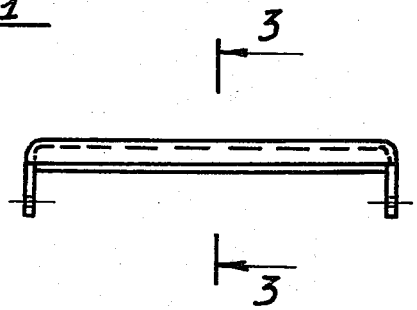
FIG. 2 is a side view of the frame of greater width.
Figure 5:
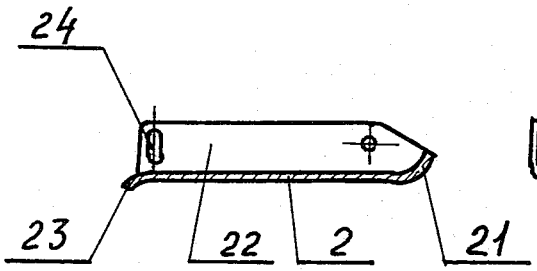
FIG. 5 is a section along 5—5 of the frame of lesser width.
Figure 4:
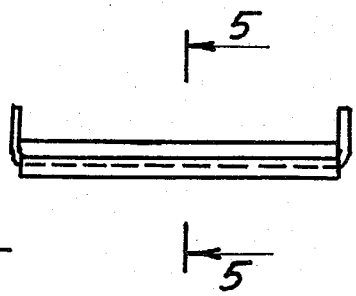
FIG. 4 is a side view of the frame of lesser width.
Figure 6:
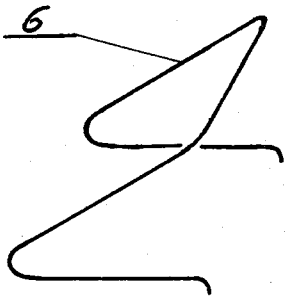
FIG. 6 shows the spring in axonometric projection.
Figure 7:
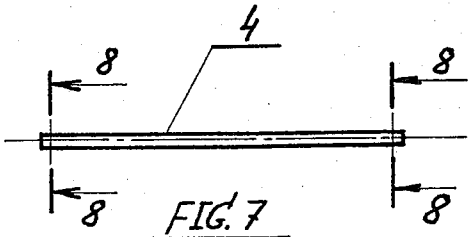
FIG. 7 shows the squeezing roll.
Figure 8:
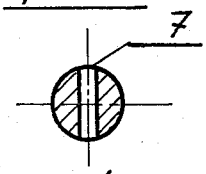
FIG. 8 is a section along 8—8 of the squeezing roll.

Referring to FIG. 1, there is shown the proposed device comprizing a frame 1 of a greater width and a frame 2. Both frames 1 and 2 are secured together with a hinge axle 3. The frame 1 with side flanges 12 and the first and the second end flanges 11 and 13, respectively, is shown in detail in FIG. 2 and FIG. 3. The frame 2 with side flanges 22 and the first and the second end flanges 21 and 23, respectively, is shown in detail in FIG. 4 and FIG. 5. The squeezing roll 4 (see FIG. 7) is secured in slots 24 (see FIG. 5) provided in the side flanges 22 of the frame 2. At the ends of said squeezing roll holes 7 are provided wherein the spring 6 arms are fixed (see FIG. 7 and FIG. 8). The sleeve 5 fitted on the squeezing roll 4 can be made of plastics and some other materials.

Figure 9:
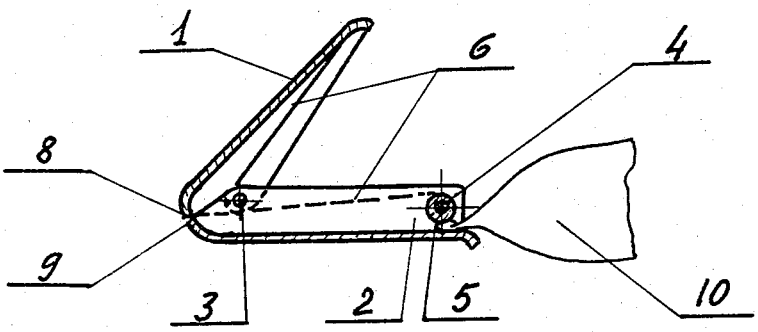
FIG. 9 shows the procedure of inserting a tube made of plastic into the proposed device.
Figure 10:
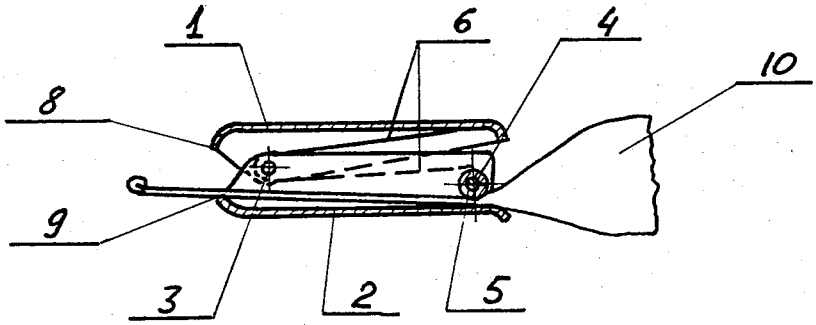
FIG. 10 illustrates position of the proposed device when the tube contents is squeezed towards the outlet by virtue of said device.
Figure 11:
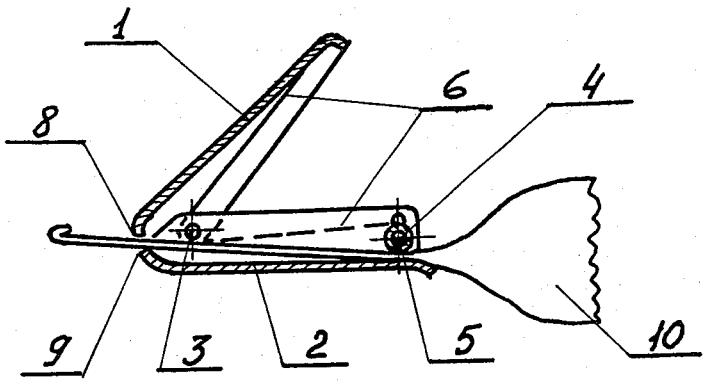
FIG. 11 shows the proposed device in a fixed position on a tube made of plastic.

The process of squeezing the tube contents out of a tube is shown in FIG. 10 and FIG. 11. Generally, the device should be applied after 30-50% of the tube contents is already used. At the beginning (see FIG. 9) the bottom part of the tube 10 made of plastic is inserted through the gap between the frame 2 and the squeezing roll 4 fitted in the sleeve 5. As this takes place, the frame 1 edge 8 joins with the frame 2 edge 9 under the compression of the spring 6, the opposite edge of the frame 1 being in a raised position.

In order to squeeze the tube contents out of the bottom part of the tube 10 towards the tube outlet the frames 1 and 2 should be finger pressed. Therewith, the edges 8 and 9, previously joined under compression of the spring 6, separate. While moving the proposed device along the tube length the bottom part of the tube slides freely between the separated edges 8 and 9 of the frames 1 and 2. Free sliding of the device along the tube length is made possible by virtue of the sleeve 5 rotation around the squeezing roll 4.

On completion of squeezing the tube contents out the empty part of the tube remains compressed. Thus, the tube made of plastics can not assume its original form being under compression pressure, exerted by the squeezing roll 4, fitted in the sleeve 5, and frame 2. The material, contained in the tube, is left in the forward (outlet) part of the tube 10 and the rest of the tube remains compressed. Due to the compressive forces exerted by frames 1 and 2 edges 8 and 9 the device is fixed on the tube in the required position and the tube contents left in the forward (outlet) part of the tube can be squeezed out by human's hand fingers.

What I claim is:

1. A device for squeezing out viscous material from tubes made of plastic comprising:

first and second generally rectangular frames with first and second end flanges and side flanges provided about their perimeters;

a hinge axle passing through the side flanges of both frames to pivotally secure the frames together along the first end flanges thereof;

a squeezing roll with ends being inserted in slots provided in the side flanges of the second frame adjacent the second end flange thereof, both ends of said squeezing roll being provided with holes;

a spring, a transverse part of which is positioned along the second end flange of the first frame and the arms of which are positioned along the side flanges of the second frame, the ends of said arms being secured in the holes provided in said squeezing roll.

2. The device as set forth in claim 1, wherein a freely rotating sleeve is fitted on said squeezing roll.

3. The device as set forth in claim 2, wherein said sleeve is made of plastics.

* * * * *